US009993045B2

(12) United States Patent
Graffeo

(10) Patent No.: US 9,993,045 B2
(45) Date of Patent: Jun. 12, 2018

(54) FLIP FLOP STYLE SANDALS WITH INTERCHANGEABLE SOLE MEMBERS

(71) Applicant: FlipRocks, LLC, Sandy Hook, CT (US)

(72) Inventor: Anthony Graffeo, Sandy Hook, CT (US)

(73) Assignee: FLIPROCKS, LLC, Sandy Hook, CT (US)

( * ) Notice: Subject to any disclaimer, the term of this patent is extended or adjusted under 35 U.S.C. 154(b) by 0 days. days.

(21) Appl. No.: 15/371,391

(22) Filed: Dec. 7, 2016

(65) Prior Publication Data

US 2017/0181493 A1 Jun. 29, 2017

Related U.S. Application Data

(60) Provisional application No. 62/272,407, filed on Dec. 29, 2015.

(51) Int. Cl.

| | |
|---|---|
| ***A43B 3/12*** | (2006.01) |
| ***A43B 3/24*** | (2006.01) |
| ***A43B 13/22*** | (2006.01) |
| ***A43C 15/16*** | (2006.01) |
| ***A43B 5/08*** | (2006.01) |
| ***A43B 5/00*** | (2006.01) |

(52) U.S. Cl.

CPC ..... *A43B 3/246* (2013.01); *A43B 3/122* (2013.01); *A43B 3/128* (2013.01); *A43B 5/002* (2013.01); *A43B 5/08* (2013.01); *A43B 13/223* (2013.01); *A43C 15/16* (2013.01)

(58) Field of Classification Search

CPC ..... A43B 3/244; A43B 3/246; A43B 3/128; A43B 3/108

USPC ..... 36/15, 100, 11.5

See application file for complete search history.

(56) References Cited

U.S. PATENT DOCUMENTS

| | | | | |
|---|---|---|---|---|
| 5,689,901 | A | 11/1997 | Bell | |
| 5,799,417 | A * | 9/1998 | Burke | A43B 3/0047 36/105 |
| 5,802,738 | A | 9/1998 | Ferniani | |
| 5,836,090 | A | 11/1998 | Smith | |
| 6,154,982 | A | 12/2000 | Bell | |
| 7,451,557 | B2 * | 11/2008 | McDonald | A43B 1/0063 36/100 |
| 7,520,069 | B2 | 4/2009 | Workman | |
| 7,584,553 | B1 | 9/2009 | Medley | |

(Continued)

*Primary Examiner* — Ted Kavanaugh

(74) *Attorney, Agent, or Firm* — McDonald Hopkins LLC

(57) ABSTRACT

The present invention relates to an interchangeable footwear device. The device may include a flip-flop sandal design wherein the device may include interchangeable structural features to allow a user to change features as associated with a particular terrain. The interchangeable footwear device includes a gripping system to traverse a number of different terrains. The footwear may include a sole member having a thong member attached to a top of the sole and a heel strap selectively attached to the sole. The heel strap may be selectively attached to the sole with a fastener that may be manually adjusted in a secured or unsecured position to remove the heel strap from the sole. In particular, the interchangeable footwear device may include a gripping unit selectively attached to the sole member of the footwear. The gripping unit may include a toe grip pad and a heel grip pad.

15 Claims, 8 Drawing Sheets

(56) References Cited

U.S. PATENT DOCUMENTS

| | | | | |
|---|---|---|---|---|
| 7,823,299 | B1 | 11/2010 | Brigham | |
| 8,474,155 | B2 * | 7/2013 | McDonald | A43B 1/0063 36/102 |
| 8,510,974 | B2 | 8/2013 | Yue | |
| 2010/0223809 | A1 | 9/2010 | Hensch | |
| 2010/0223812 | A1 * | 9/2010 | Batanero Bastida | A43B 3/103 36/100 |
| 2016/0029739 | A1 * | 2/2016 | Dias | A43B 1/02 36/103 |

* cited by examiner

FLIP FLOP STYLE SANDALS WITH INTERCHANGEABLE SOLE MEMBERS

CROSS REFERENCE TO RELATED APPLICATIONS

The application claims the benefit of U.S. Provisional Patent Application No. 62/272,407, filed on Dec. 29, 2015 and entitled "Flip Flop Style Sandals with Interchangeable Sole Members," which is hereby incorporated by reference in its entirety.

TECHNICAL FIELD

The present invention relates to the field of footwear and more particularly to flip flop style of footwear that includes interchangeable features and variable functionality in how the footwear is worn by its user.

BACKGROUND

Footwear of known designs and configurations have utilized selectively changeable ornamental features, such as decorative emblems, straps, and the like. By and large, these ornamental features were integrated over existing, functional features in the footwear, usually along the top portion of known footwear embodiments. The advantage of these ornamental features related to the users ability to have single item whose appearance could be reconfigured to reduce the number of different pieces of footwear that person might need. However, the functioning aspects of these shoes was not altered, and a person desiring footwear with greater traction would still need to purchase completely separate shoes.

In response, more functional, interchangeable spikes and/or cleats were designed to be removable from the sole. Here, the user was able to remove or replace these spikes in order to attain better traction with a single shoe. Alternatively, a cavity may be formed across the bottom of the sole, with a replaceable traction plate fitting in the cavity. Examples of such footwear can be found in U.S. Patent Publication 2010/0223809 and U.S. Pat. Nos. 7,520,069 and 5,836,090.

Separately, extraneous devices have been developed to removably fit over existing footwear to improve traction. In effect, these removable devices are not specific to any single piece of existing footwear and, instead, are designed to cooperate with a wide array of shoes, usually by engaging the wearer's foot across both the heel and toe area. Examples of such devices can be found in U.S. Pat. Nos. 8,510,974; 6,154,982; and 5,689,901.

Other designs have attempted to emphasize simplicity and versatility in a sandal-like shoe. U.S. Pat. No. 5,802,738 describes a shoe held together by an upper and engagement mechanism which penetrate through apertures in the sole so as to avoid the need for gluing the sole and the upper. U.S. Pat. No. 7,823,299 discloses footwear that is convertible between a flip-flop and a sandal by repositioning a heel and/or forefoot band between a storage and use-based positioning integrated within the sole.

SUMMARY

In view of the foregoing, footwear that affords interchangeable functionality, regarding traction and engagement options with the wearer's foot, would be welcome. In particular, sandals and flip-flops, which are often preferred for the open-air feel they afford (in comparison to close-toed shoes and boots, which can be heavier, warmer, and more uncomfortable), having such interchangeable functionality would be particularly welcome.

A sandal and/or flip flop with interchangeable functionality is disclosed. The device may include a flip-flop sandal design wherein the device may include interchangeable structural features to allow a user to change features as associated with a particular terrain and/or anticipated range of conditions. The interchangeable footwear device includes a gripping system to traverse a number of different terrains. The footwear may include a sole member having a thong member attached to a top of the sole and a heel strap selectively attached to the sole. The heel strap may be selectively attached to the sole with a fastener that may be manually adjusted in a secured or unsecured position to remove the heel strap from the sole.

In particular, the interchangeable footwear device may include a first gripping unit selectively attached to the sole member of the footwear. The first gripping unit may include a toe grip pad and a heel grip pad. The first gripping unit may include at least one protrusion such as a spike. The front portion and rear portion may be individually attachable to the bottom of the sole member.

A second gripping unit may be selectively attached to the sole member of the footwear. The second gripping unit may include a front portion and a rear portion. The second gripping unit may be a durable material, such as a hard polymer or rubber, and be formed into a pattern designed for creating a traction application different from the first gripping unit. The front portion and rear portion may be individually attachable to the bottom of the sole member.

A third gripping unit may be selectively attached to the sole member of the footwear. The third gripping unit may include a front portion and a rear portion. The third gripping unit may be a soft material, such as a felt, and be formed into a pattern designed for creating a traction application different from the first and second gripping units. The front portion and rear portion may be individually attachable to the bottom of the sole member.

The interchangeable footwear device along with the first, second, and third gripping units may be specifically designed for fishing, hiking and/or kayaking. In any of these aspects, the sole member of the interchangeable footwear device includes a toe guard such as a molded toe guard.

Thus, one embodiment of the invention contemplates footwear encompassing any combination of the following features:

a central body having a an elongated shape with a top facing surface, a ground facing surface, and a peripheral sidewall defining a thickness of the central body and having a plurality of engagement channels formed in the sidewall;

a thong assembly affixed to the central body on the top facing surface;

a detachable heel strap affixed to the central body;

a heel gripping pad affixed to the central body on the ground facing surface proximate to the heel strap;

a front gripping pad affixed to the central body on the ground facing surface and set apart from the heel gripping pad so that a portion of the central body remains exposed on the ground facing side;

a middle gripping pad affixed to the central body on the ground facing surface between the heel gripping pad and the front gripping pad;

at least one comfort pad affixed to thong assembly or the heel strap;

a top sole affixed to the central body along the top facing surface;

a toe guard;

wherein each of the heel gripping pad and the front gripping pad at least partially extend upward and around a portion of the sidewall to form a plurality of engagement loops positioned within corresponding engagement channels of the sidewall to selectively secure the heel gripping pad and the front gripping pad to the central body.

wherein the toe guard is integrally formed on the front gripping pad;

wherein the toe guard is positioned proximate to one of the engagement loops on the front gripping pad;

wherein at least one of the heel gripping pad and the front gripping pad include through-holes and further comprising at least one stud selectively positioned to pass at least partially through the through-hole;

wherein a plurality of studs and through-holes are provided;

wherein the studs each comprise cylindrical bodies with a cross sectional shape selected from the group consisting of: an X-shape; a circle; an oval; a polygon; an ellipses; an arch; and a crescent;

wherein at least one stud has a hollowed out, annular shape;

wherein the heel strap is attached to the sidewall by way of at least one screw or snap-fit rivet;

wherein the sidewall cooperates with the heel strap and the heel strap rotates downward to selectively stow the heel strap when the heel strap is not in use;

wherein the engagement channels are formed on opposing portions of the sidewall adjacent to each of the heel gripping pad and the front gripping pad; and wherein at least one engagement channel is formed at a front end of the central body opposite the heel strap.

Specific reference is also made to the appended claims, drawings, and description below, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

DESCRIPTION OF THE DRAWINGS

Operation of the invention may be better understood by reference to the detailed description taken in connection with the following illustrations. These appended drawings form part of this specification, and any written information in the drawings should be treated as part of this disclosure. In the same manner, the relative positioning and relationship of the components as shown in these drawings, as well as their function, shape, dimensions, and appearance, may all further inform certain aspects of the invention as if fully rewritten herein.

In the drawings.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

The present invention pertains to an interchangeable footwear device. The device may include a flip-flop sandal design wherein the device may be an all-terrain and amphibious flip flop. The footwear may be made rugged and tough to allow a user, such as an outdoor enthusiast, to take advantage of the interchangeable features directed for use with various terrains. In one embodiment, the interchangeable footwear device may allow the user to be active within a body of water with the freedom of a flip flop, utilizing the traction and stability of a studded wading boot.

The interchangeable footwear device may include a flip-flop sandal design wherein the device may include interchangeable structural features to allow a user to change features as associated with a particular terrain. The footwear may include a sole member having a thong member attached to a top of the sole member and a heel strap selectively attached to the sole member. The heel strap may be selectively attached to the sole with a fastener that may be manually adjusted in a secured or unsecured position to remove the heel strap from the sole. The interchangeable footwear device includes a gripping system to traverse a number of different terrains.

Figure 1:
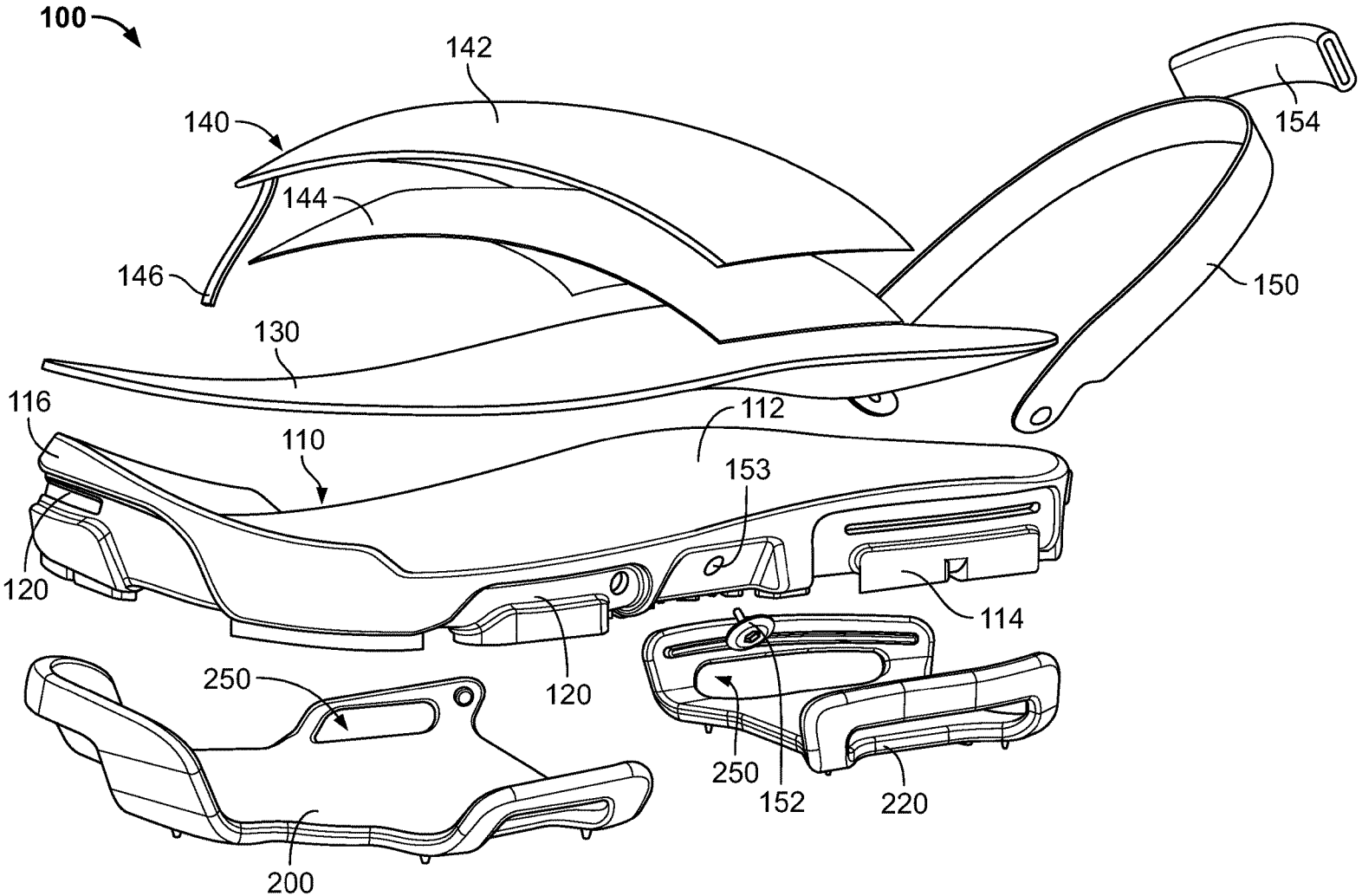
FIG. 1 is an exploded perspective view of certain described aspects of the sandal.

With reference to one aspect of the invention shown in exploded view in FIG. 1, interchangeable sandal 100 is formed around a body 110 made from a durable, medium density material, such as ethylene-vinyl acetate (EVA) foam or other similar materials. The body 110 substantially conforms to the shape of a human foot with an elongated, relatively flat top surface 112. The thickness of the body 110 defines a sidewall into which a number of gripping channels 120 may be formed. The underside 114 of body 110 will be described in greater detail below. An optional toe guard 116 may be formed by extending a peripheral wall around a portion of the forefoot section (i.e., the section opposite heel strap 150) above the top surface 112.

Top sole 130 is positioned along the top side 112 of the body 110. The top sole 130 may be formed from EVA foam, synthetic leather, a combination thereof, and/or other materials commonly used in the footwear industry. The material of top sole 130 should be comfortable to touch, durable, preferably water resistant or waterproof, and provide sufficient traction with the foot to avoid slippage or awkward sensations in/for the wearer. The top sole 130 may be permanently affixed to the body 110 by way of appropriate adhesives and/or fasteners. Alternatively, top sole 130 may be removably fixed so as to afford further interchangeability and functionality to the shoe 100; for example, by having non-slip pads, additional padding, and the like.

Thong assembly 140 is positioned proximate to or integrated with the top surface 112. Assembly 140 consists of synthetic leather, neoprene, or other durable yet flexible material forming top strap 142. Strap 142 conforms to the top of the wearer's foot and may include a thong liner 144 made of fabric or other materials selected to enhance the wearer's comfort. The liner 144 may completely or partially encase the strap 142, and a plurality of materials may be used, both on the inner and outer facing portions so as to enable brand placement, additional styling, or further functionality. In some aspects, the strap 142 has a curved shape, such as a V-shape or a C-shape, when viewed from the top with sufficient width to comfortable engage the wearer's foot and maintain the positioning of the sandal 100 thereon. One or more toe straps 146 connect the strap 142 to the body 110 by way of adhesives and/or fasteners. Such fasteners and adhesives may be applied to the body 110 with a through-hole provided in the top sole 130, or they may connect directly to the top sole 130 itself. Toe strap 146 may be made from similar materials as the top strap 142, although the size and shape of the toe strap 146 should be optimized for the wearer's comfort and, more particularly, to fit between the wearer's toes. In some aspects, toe strap 146 may be optional.

Heel strap 150 is positioned at the opposite end of the body 110 from toe guard 116. Strap 150 may be made from similar material as those selected for the thong assembly 140. Heel strap 150 may be affixed to the body 110 by way of a screw 152, although a snap-fit rivet, pin, or other removable fastener may be employed on one or both sides (i.e., the inner foot side and the outer foot side) of the body. Screw 152 would conform to an appropriate formed aperture 153 in the body, with the aperture possibly having a liner with threads affixed therein to engage the screw 152. The strap 150 could be permanently fixed to the body in a rotatable fashion on one or both sides.

Figure 2B:
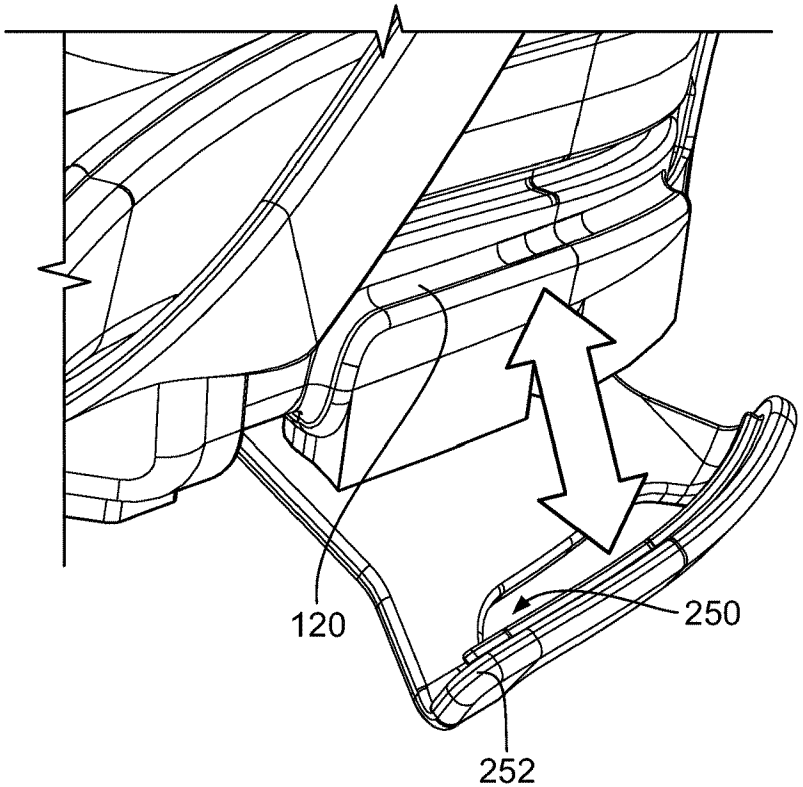
FIG. 2B is a perspective illustration of the loop and channel arrangement by which the gripping pads may be attached to the body.
Figure 2A:
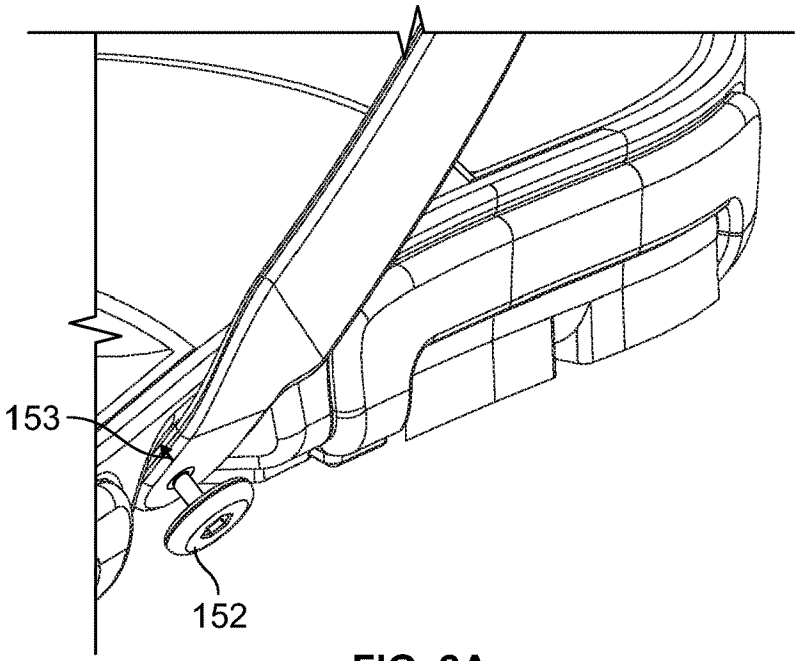
FIG. 2A is a perspective view of the attachment of the heel strap to the body according to certain aspects.

FIG. 2A shows an exploded view of how screw or snap-fit rivet 152 may be fitted into aperture 153 to selective secure the heel strap 150. The small white arrow in FIG. 2A indicates the general direction in which screw/rivet 152 is inserted or affixed to the body. This arrangement may be provided on the instep, on the outer facing side, or both sides of the body at its elongated portion (e.g., proximate to or, more preferably, beneath where the thong assembly 140 is secured/affixed to the body 110 and/or top sole 130).

Figure 2C:
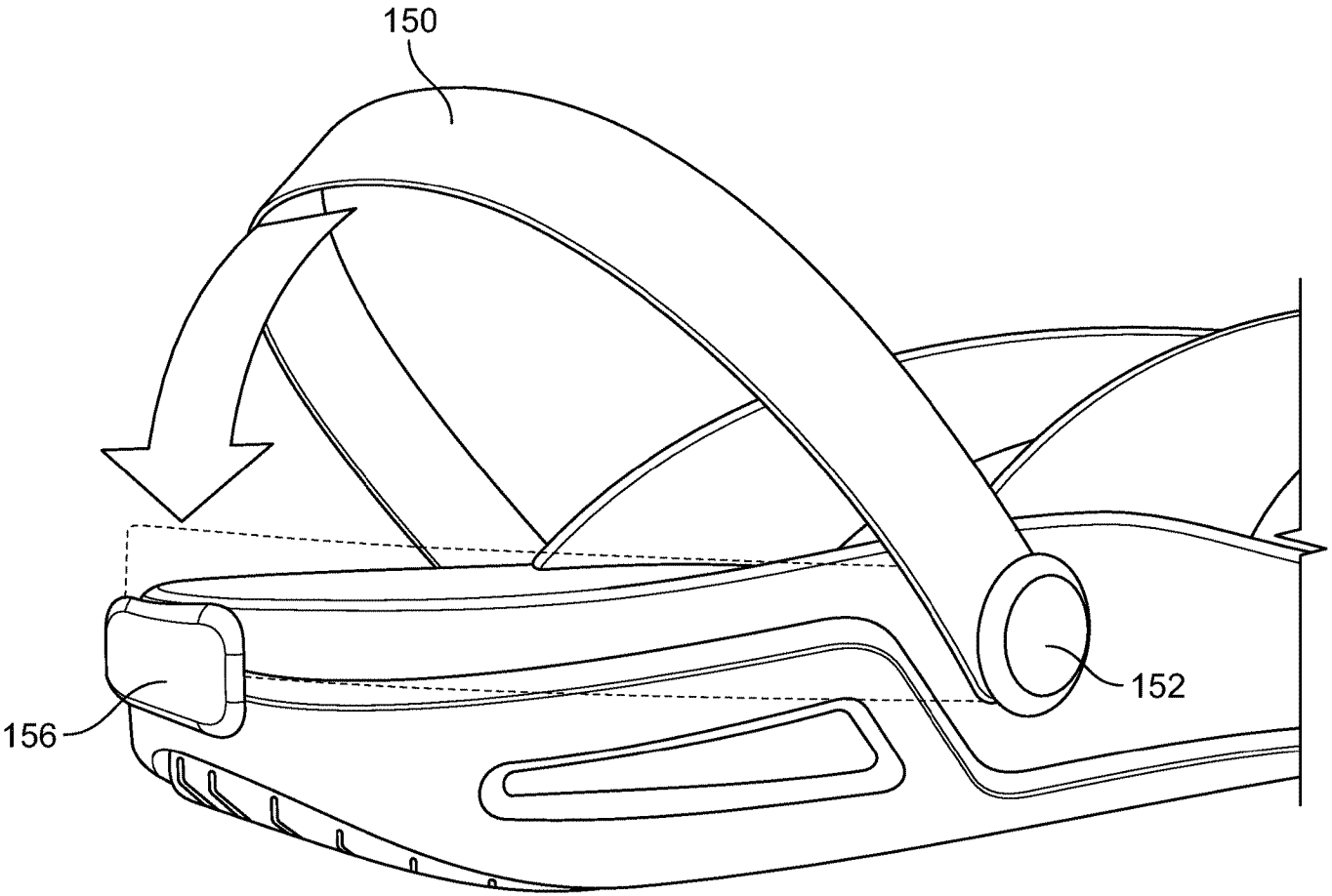
FIG. 2C is a perspective illustration of how the heel strap may be moved into a stowed position.

When one end of the strap 150 is disengaged while the other remains rotatably fixed to the opposing side, it may be possible to store the heel strap in stowed position as seen in FIG. 2C. In particular, strap 150 rotates along the axis indicated by the shaded arrow in FIG. 2C so as to be secured by tab 156. Tab 156 may be formed with the grip pad 220, the body 110, or the top sole 130. In some embodiments, it defines a snap-fit retention channel between the tab 156 and the body 110, or tab 156 may comprise its own mechanism for keeping the strap 150 in its stowed position flush against the body. In this manner, the wearer is afforded the option of using sandal 100 as a flip-flop style shoe without contacting the back of the heel, which some wearer's may find irritating or unnecessary.

One or more comfort pads 154 may be integrated on, designed to fold around, adhered to, or otherwise fastened upon the inner facing side of the strap 150 (i.e., the facing that comes into contact with the wearer). Pad 154 may be made from fabric and/or other soft, cushioning material that minimizes chafing and irritation of the heel and skin. Similar pads may be provided to the thong assembly 140, in addition to or in place of liner 144.

Front grip pad 200 and rear grip pad 220 conform to the underside of the body 110. Each pad 200, 220 may be integrally formed with attachment loops 250. Loops 250 cooperate with the gripping channels 120 to secure the grip pads 200, 220 to the sandal 100. Gripping channels 120 may include an additional inner ledge that forms a snap fit with a lip provided on the inner facing portion of loops 250. The grips 200, 220 and, more specifically, the loops 250 may be formed from synthetic rubber or other durable yet flexible polymeric materials. The loops 250 will have sufficient elasticity to be fitted around and into the gripping channels 120.

FIG. 2B illustrates how lip 252 may be formed along the inner portion of the loops 250. As indicated by the solid black arrow, the elastic loop 250 fit over and into channel 120. Insofar as these loops 250 and channels 120 are formed on opposing sides of the body 110, the grip pad 200 or 220 is held in place on the bottom side 114 of body 110, effectively serving as a replaceable tread or traction piece for sandal 100. Further, because the pads 200, 220 are bifurcated, the wearer may mix and match different gripping pads to meet the necessities of the environment. Further, the bifurcated nature of the pads 200, 220 allows for greater heel to toe flexibility in the sandal itself and, generally speaking, improves comfort for the wearer.

Figure 3:
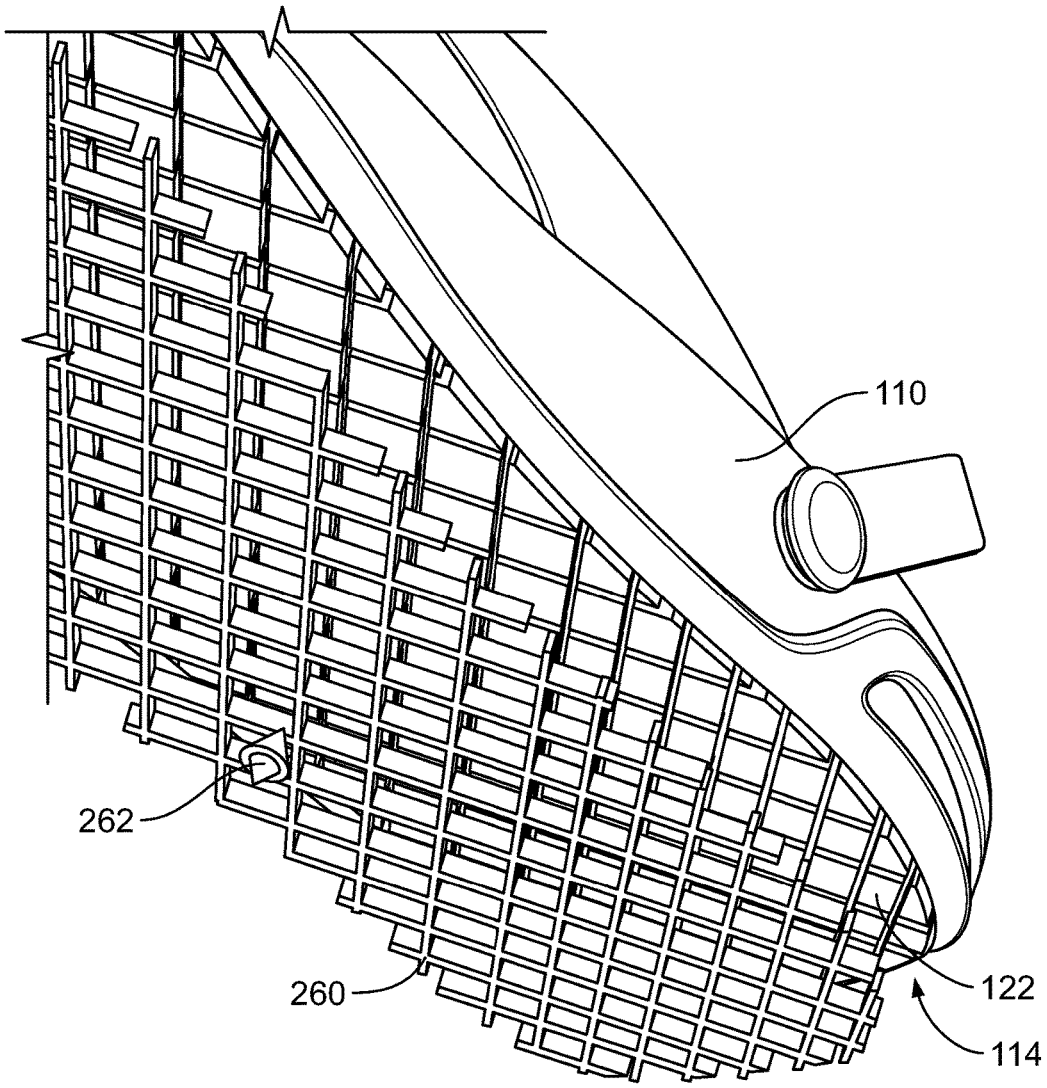
FIGS. 3, 4A and 4B are bottom perspective or bottom plan views of the interchangeable gripping pads according to certain aspects.

As seen in FIG. 3, one or both pads 200, 220 may be formed of an embedded mesh 260 that cooperates with cross-hatched channels 122 formed on the bottom side 114 of body 110. One or more grip tines 262 may secure the pad 200, 220 and mesh 260 by way of a screw or snap-fit connection similar to that described from the heel strap screw 152 and aperture 153. Additionally or alternatively, channels 122 may allow for a snap-fit connection to retain the pad 200, 220 in place as is.

Figure 4A:
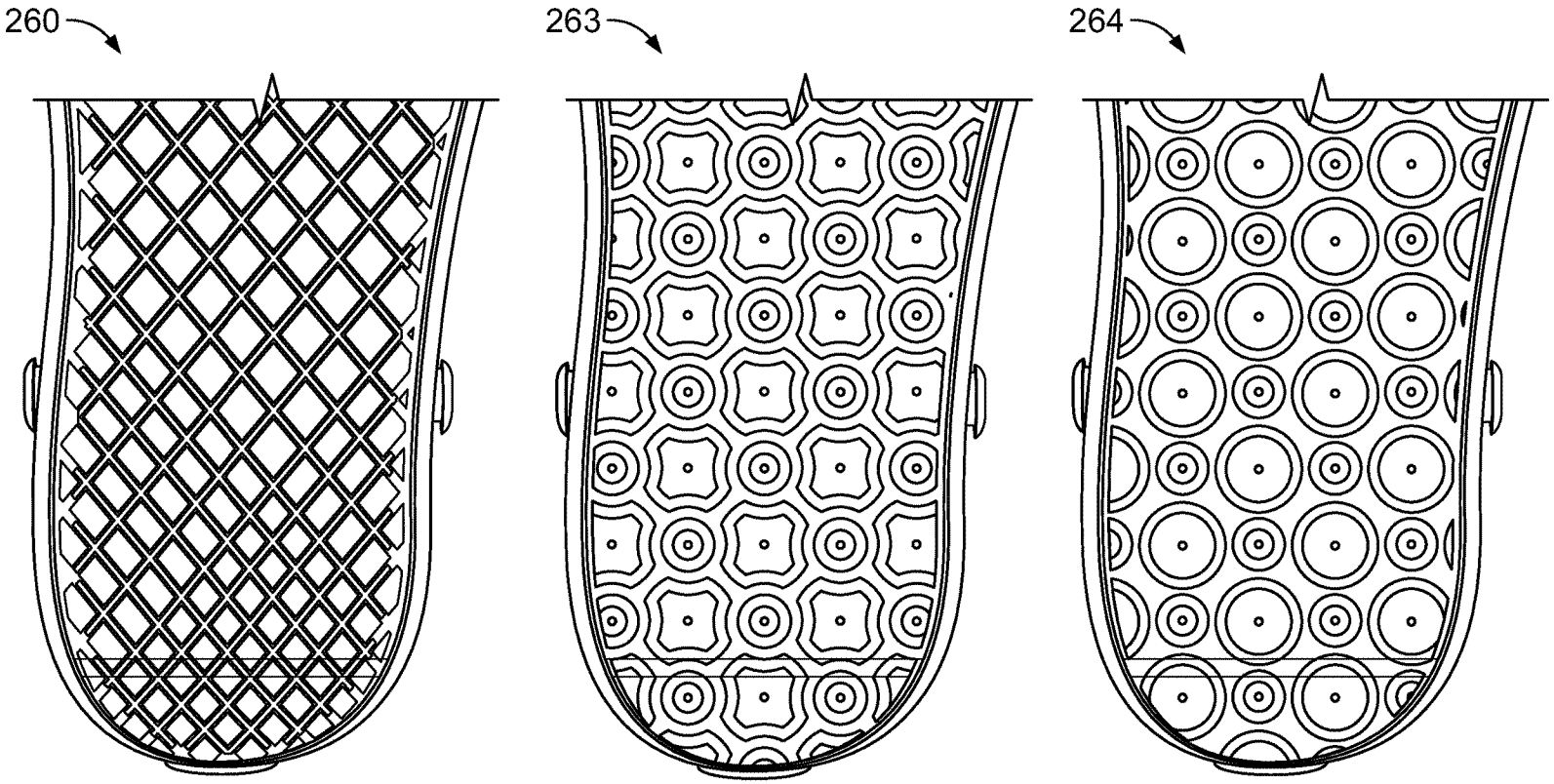

FIG. 4A illustrates a series of alternative patterns that may be formed on the bottom of pads 200, 220. Generally speaking, patterns 263, 264 can be optimized for traction by way of ridges, treads, and other designs, as seen in the middle 263 and left most examples 264 of FIG. 4. The right most example 260 is an illustration of the embedded mesh-in-channels pattern described in FIG. 3. While regular, repeating patterns are shown, irregular, random, or specialized left- and right-footed designs could be implemented. In the same manner and with reference to FIG. 1, designs can be optimized for the front pad 200, the heel pad 220, or any intermediary pads (not shown). Also, smooth or lightly textured facings are possible.

Figure 4B:
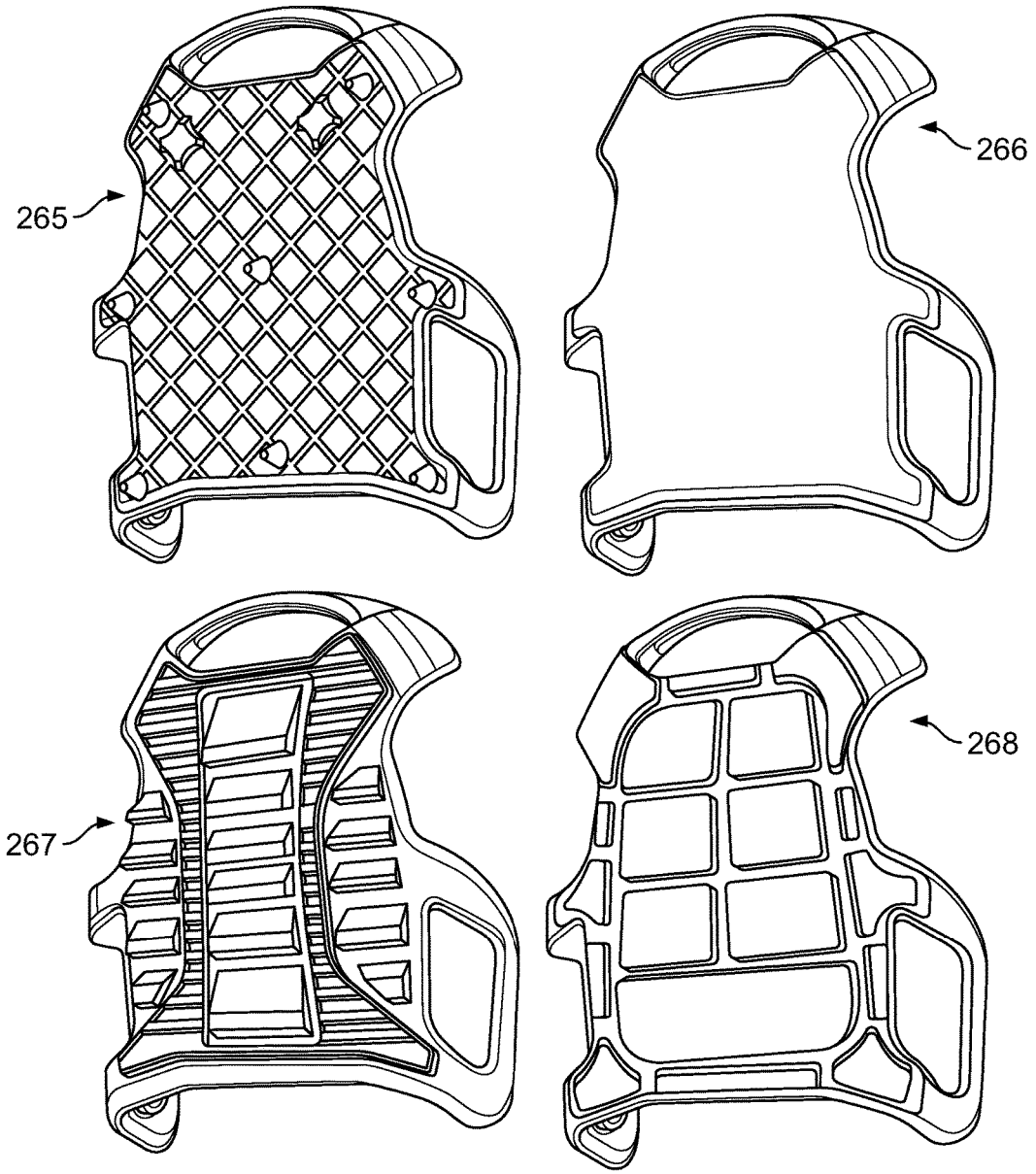

FIG. 4B shows still further possible configurations for the gripping pads. Pad 265 is configured for extreme terrain and aquatic environments, with a textured tread pattern and a plurality of studs of two separate cross sectional shapes. Pad 266 features a felt sole to allow for better feel and stability on uneven terrain and/or slippery or algae covered surfaces. Pad 267 is designed for hiking this a series of ridges aligned in a parallel configuration that is further segregated by longitudinal channels, thereby allowing for flexibility and engagement with loose soil. Pad 268 is designed for comfort, with highly durable, flat surfaces and only minimal treads and channels. As noted above, any of the surfaces shown in FIGS. 4A and 4B could combined on separate gripping pads provided to the central body of a single sandal.

Figure 5A:
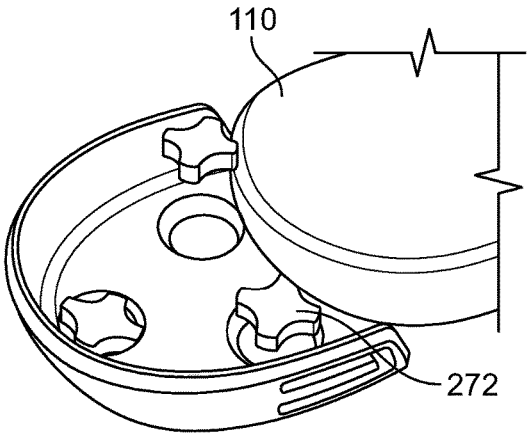
FIGS. 5A through 5E are perspective views of how studs cooperate with the gripping pads according to certain aspects.

In another aspect, specialized cleats may be integrated into one or more of the pads 200, 220. As seen in FIG. 5A, through-holes 270 having a diameter that is smaller than cleats or studs 272 are formed in one of the pad 220. This arrangement may also be used in any of the other pads. The diameter of studs 272 is such that they are held in place within the through-hole 270 and between the bottom surface (not visible in FIGS. 5A) of the body 110 and the side of the pad 220 facing the body 110. In this manner, by simply releasing the pad 220 from the body 110 via the loops and gripping channels described above, a wearer can quickly and easily change the studs 272. It is also possible to omit studs 272 in this design so as to allow the through-holes 270 to serve traction. In the same manner, studs 272 need not protrude out or away from the bottom-facing surface of the pad 220 and, instead, might have a specialized gripping surface (e.g., rubber, tackified materials, etc.) that is flush or even slightly inset from from the bottom-facing surface.

Figure 5C:
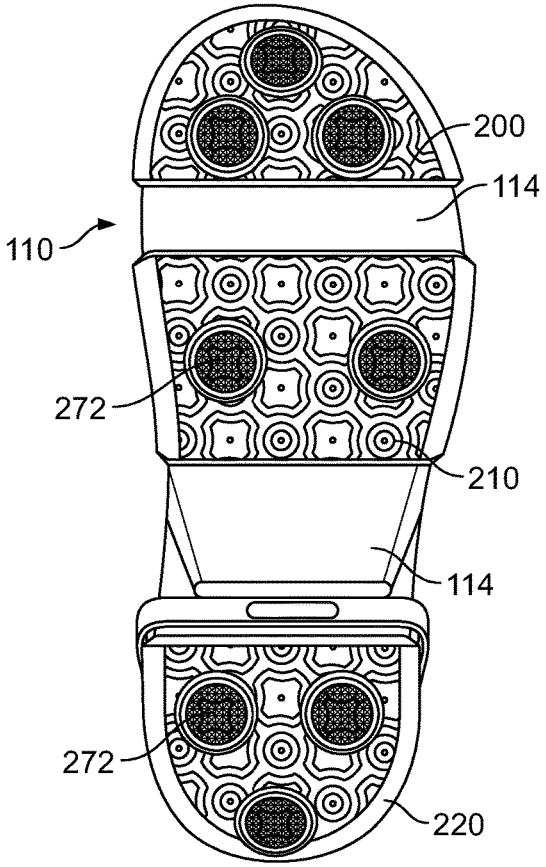
Figure 5B:
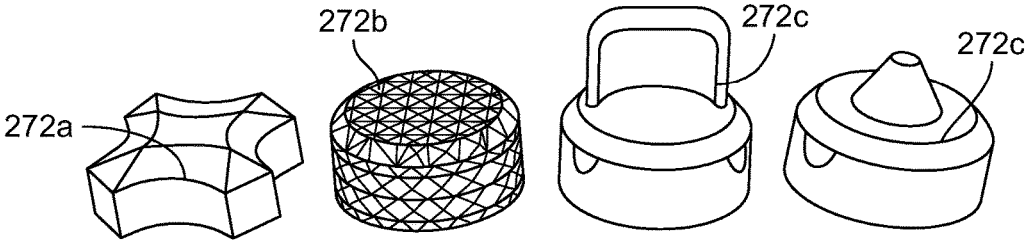

Non-limiting examples of studs 272 are shown in FIG. 5B. In one aspect, the stud is formed as a cylinder having a cross-sectional shape that corresponds to and cooperates with the through-hole. Stud 272*a* shows an x-shaped cross section, while studs 272*b* and 272*c* rely on circular cross sections. It is also possible to use other shapes, such as polygons, ovals, ellipses, arches/crescents, annular or hollowed-out cylinders, and the like. An optional retention lip, tabs, or one or more radial flanges can be formed on the end in contact with the bottom surface of the body to ensure the stud remains in place. The elevation (i.e., the axial height of the cylinder) can be varied among stud types to allow the show to gain better traction in soft ground or other pliable surfaces. One or more of the surfaces of the studs can be textured, grooved, dimpled, ridged, or otherwise embossed to enhance certain aspects, as seen on stud 272*b*. Additionally or alternatively, one or more optional flanges or protrusions can be formed on the end of the cylinder that makes contact with the ground, as seen on stud 272*c*. The studs may be made from plastics, metals, or other materials that are commonly used in the soles and/or cleats of shoes and sandals. Rather than being held between the pad and the body, these studs may also be fastened to the body and/or the pad by being screwed or snap-fit into place.

Although two grip pads are shown, the arrangement—including loops and gripping channels—enables multiple pads to be provided on a single shoe. FIG. 5C illustrates an embodiment in which three pads 200, 210, 220 are provided with cleats 272 in each individual pad, although cleats need not be evenly distributed or even provided in one or more of the pads. Notably, patterns may still also be provided in the bottom-facing side of the pad in combination with the through-hole-cleat arrangement, also as seen FIG. 5C. Further, portions of the bottom surface 114 of the body 110 may be exposed and allow for flexing of the body and other purposes, as described in greater detail below.

Figure 5D:
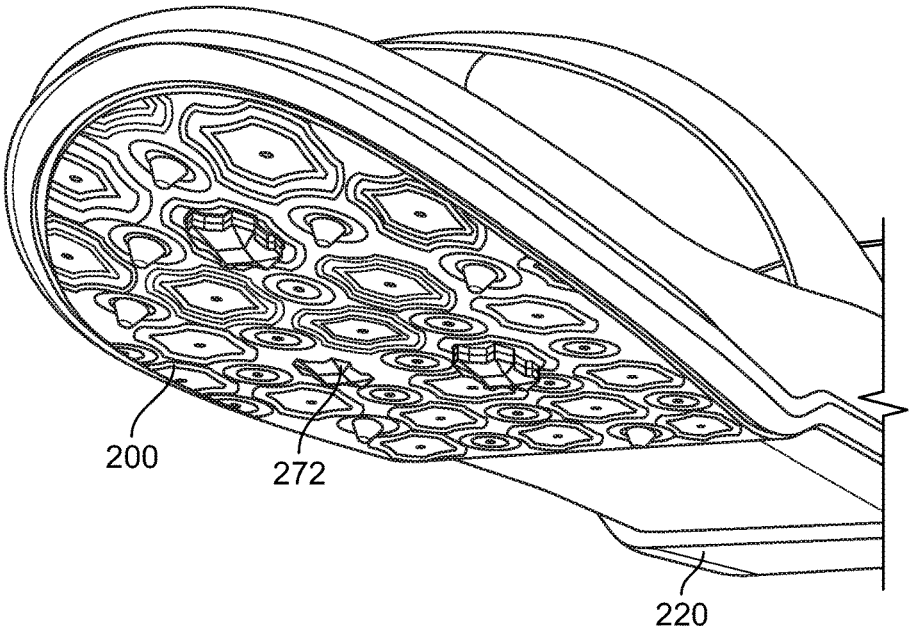
Figure 5E:
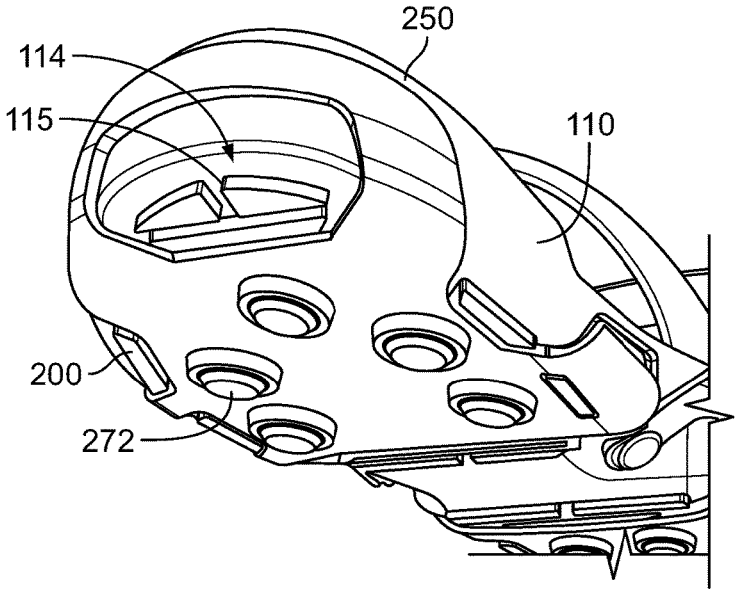

FIGS. 5D and 5E illustrate still further possible arrangements for the pads and how the pads may cooperate with the body. In FIG. 5D, front-most pad 200 includes an arrangement of different cleats 272. In contrast, heel pad 220 incorporates a smooth surface (e.g., felt, gripping rubber, etc.). As such, the wearer may rely on the ball of the foot for traction, while simultaneous walking on his or her heels for gripping.

FIG. 5E shows that the pads 200, 210, and/or 220 need not completely cover the bottom surface 114 of body 110. Instead, relatively large loops 250 can be provided in conjunction with a corresponding gripping channel 120 (not visible)—in this particular instance, so as to encompass the toe portion. Treads 115 could be formed on the bottom surface 114 to further complement the functionality of sandal 100. In one aspect, the loop provided at the toe at the tip of the sandal can be integrally formed into the toe guard described in FIG. 1 above. Also, as with FIG. 5D, optional through-holes and cleats 272 are provided.

Thus, the bottom surface of the body may be a functioning aspect of the sandal, to the extent it has treads. The elevation (i.e., the thickness) of one or more of the pads can be deliberately varied so as to allow portions of the bottom surface to be engaged while walking or, in the alternative, spaced apart from the ground to avoid engagement. This elevation difference, in combination with having the pads spaced apart so that the bottom surface of the body is exposed to the ground also permits the sandal to flex and twist in comparison to a sandal where the sole is provided as a unitary piece. In turn, this allows for incorporating harder, stiffer, and/or more durable plastics and other materials into the construction of the pads without sacrificing the comfort provided by the body itself (in this regard, use of a top sole provides still further comfort).

In other embodiments, the bottom surface coming into contact the gripping pads may be contoured, textured, or otherwise form-fitting to cooperate with a corresponding surface/shape on the pads, thereby ensuring the pads do not slip or shift relative to the body while the wearer is walking. In still further embodiments, exposed portions of the bottom surface of body could possess the largest elevation (in comparison to the pads) to once again afford the desired presentation (e.g., traction, grip, etc.) by the sandal 100.

Further still, if the heel strap is disengaged, in could be held flush against the side wall of body 110, possibly even within a specially designed gripping channel wrapping around the back heel.

The loops and gripping channels are provided at a plurality of points around the periphery of the body of the sandal. As one example each pad has at least two, three, or four sets of loops and channels. The positioning of the loops and channels relative to one another should ensure minimal shifting or sliding of the pad relative to the body. For example, a loop and channel can be provided at the toe, and on the inner and outer facing side of the body to provide secure, three-point contact. Having a pair of loops and channels on opposing sides of the pad is preferred, although their precise positioning may be slightly offset to one another.

The loops in the pads have sufficient flexibility to be wrapped over and into the channels. Additional means to allow the wearer to grasp the loop may be formed, such as an indent (on the pad and/or in the body). Tabs might also be formed along the loop.

The gripping pads or units may be shaped or molded in a particular way that form fits to the shape of the sole member. The sole member may also be provided within a recessed area with various protrusions that extend from the sides or bottom and the toe grip member may include flange portions and apertures wherein the flange portions are selectively attached within the recessed portions and the apertures receive the various protrusions for a secure snap or frictional attachment between the toe grip pad and the sole member. Additionally, the heel grip pad may be shaped or molded in a particular way that form fits to the shape of the sole member. The sole member may include a recessed area with various protrusions that extend from the sides or bottom and the heel grip member may include flange portions and apertures wherein the flange portions are selectively attached within the recessed portions and the apertures receive the various protrusions for a secure snap or frictional attachment between the heel grip pad and the sole member.

As noted above, any of the pads and/or body may be a durable material, such as a hard polymer or rubber, and be formed into a pattern designed for creating a traction application different from the other elements. Soft materials, such as a felt, and be formed into a pattern designed for creating a traction application may also be used.

The top sole may include a thong attached to the upper side and a heel strap selectively attached to the sole member with fasteners. The thong may include a liner and be made of a synthetic leather, neoprene material, fabric, or combination thereof. The sole member may include a top sole member made of a EVA foam, synthetic leather, or other material. The sole member may be made of a medium density EVA foam or other molded polymer. The toe grip pad and the heel grip pad may be made of synthetic rubber. The heel strap and comfort pad may be made of synthetic leather, neoprene material, or combination thereof.

The interchangeable sandal contemplated herein may be specifically designed for fishing, hiking and/or kayaking. Stated another way, the interchangeable footwear device may include a gripping system specially formulated with injection-molded removable grips that are designed specifically for various respective applications/terrains to maximize traction, stability, and comfort. A molded toe guard (provided in the body or in the pad itself, as described in connection with FIG. 5E above) provides added utility for sandals that may be intended for hiking or fishing, where it is likely that rocks and loose earth might otherwise become lodged between the top sole and the wearer's foot. A similar guard could be extended around other portions of the periphery for the same purpose.

The provision of the body and top sole also allow for the sandal/flip flop to be provided with orthopedic support along the arch of the foot. This arrangement is more comfortable than traditional flip-flops, which often present only a flat surface for the wearer's foot.

Each pad can be varied for different activities so that the wearer is not required to change pads for every activity. For example, the front pad could be be specially formulated rubber composites to maximize traction in aquatic environments. Studs (as described in connection with FIG. 5B above) may be added to make sure that footing is firmly planted even when traversing slime-covered rocks in a turbulent aquatic condition in pursuit of fishing activities. In contrast, the middle and/or heel pad could be designed to assist the user in a hiking terrain. This embodiment would replace bulky, sweaty boots and allow feet to breath and still grip the trail while hiking. This embodiment includes rubber composite molding with an aggressive traction pattern to for rocky terrain along a trail. If present, the third pad might include a smooth base to replace the traditional water shoe. This embodiment helps prevent excess gravel or sand from being trapped within traditional water shoes and getting blisters that would not leave marks on a boating vessel. The base of the grips includes felt traction pads (or even felt-tipped, flush-mounted studs) for improved traction against a surface of a boating vessel. Other combinations are possible, and any single example in this paragraph could be applied to multiple pads.

Notably, each structural feature may be provided with various colors and arrangements. Indeed, the reliance on EVA and other plastics, in combination with the assembly shown in FIG. 1, affords for many different style and fashion choices. For example, different colored heel straps might be employed and/or, to the extent the loops are visible along the sides of the shoes, the color and appearance of the pads can be varied to afford the wearer with a multiplicity of style choices above and beyond the functionality provided by these pads.

The heel strap may be selectively biased into the stowage position against the sole member. The heel strap may be held in the stowage positioned by at least one magnet placed between the heel strap and sole member. In this embodiment, a cushion may be provided adjacent to the heel strap along an arch portion.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof.

What is claimed is:

1. A sandal comprising:

a central body having an elongated shape with a top facing surface, a ground facing surface, and a peripheral sidewall defining a thickness of the central body and having a plurality of engagement channels formed in the sidewall;

a thong assembly affixed to the central body on the top facing surface;

a detachable heel strap affixed to the central body;

a heel gripping pad affixed to the central body on the ground facing surface proximate to the heel strap;

a front gripping pad affixed to the central body on the ground facing surface and set apart from the heel gripping pad so that a portion of the central body remains exposed on the ground facing side;

wherein each of the heel gripping pad and the front gripping pad at least partially extend upward and around a portion of the sidewall to form a plurality of engagement loops positioned within corresponding engagement channels of the sidewall to selectively secure the heel gripping pad and the front gripping pad to the central body.

2. The sandal according to claim 1 further comprising a toe guard.

3. The sandal according to claim 2 wherein the toe guard is integrally formed on the front gripping pad.

4. The sandal according to claim 2, wherein the toe guard is positioned proximate to one of the engagement loops on the front gripping pad.

5. The sandal according to claim 1, wherein at least one of the heel gripping pad and the front gripping pad include through-holes and further comprising at least one stud selectively positioned to pass at least partially through the through-hole.

6. The sandal according to claim 5, wherein there are a plurality of studs and through holes.

7. The sandal according to claim 5, wherein at least stud comprises a cylinder with a cross sectional shape selected from the group consisting of: an X-shape; a circle; an oval; a polygon;

an ellipses; an arch; and a crescent.

8. The sandal according to claim 7, wherein the at least one stud has a hollowed out, annular shape.

9. The sandal according to claim 1, wherein the heel strap is attached to the sidewall by way of at least one screw or snap-fit rivet.

10. The sandal according to claim 1, wherein the sidewall cooperates with the heel strap and the heel strap rotates downward to selectively stow the heel strap when the heel strap is not in use.

11. The sandal according to claim 1, wherein the engagement channels are formed on opposing portions of the sidewall adjacent to each of the heel gripping pad and the front gripping pad.

12. The sandal according to claim 1, wherein at least one engagement channel is formed at a front end of the central body opposite the heel strap.

13. The sandal according to claim 1, further comprising a middle gripping pad affixed to the central body on the ground facing surface between the heel gripping pad and the front gripping pad.

14. The sandal according to claim 1, further comprising at least one comfort pad affixed to thong assembly or the heel strap.

15. The sandal according to claim 1, further comprising a top sole affixed to the central body along the top facing surface.

* * * * *